US006874632B2

(12) United States Patent
Thiessen

(10) Patent No.: US 6,874,632 B2
(45) Date of Patent: Apr. 5, 2005

(54) STORAGE DEVICE FOR COILED ARTICLES

(76) Inventor: Keith Thiessen, R.R. 2, Wetaskiwin, Alberta (CA), T9A 1W9

( * ) Notice: Subject to any disclaimer, the term of this patent is extended or adjusted under 35 U.S.C. 154(b) by 0 days.

(21) Appl. No.: 10/756,000

(22) Filed: Jan. 13, 2004

(65) Prior Publication Data

US 2005/0006276 A1 Jan. 13, 2005

(30) Foreign Application Priority Data

Jul. 11, 2003 (CA) ..... 2435015

(51) Int. Cl.[7] ..... B65D 85/66

(52) U.S. Cl. ..... 206/397; 206/409; 242/399; 242/400.1; 242/406; 242/597.6; 242/597.8; 242/129; 191/12.2 R; 137/355.12; 137/355.16

(58) Field of Search ..... 206/389, 397, 206/403, 407, 408, 702, 409; 137/355.12, 355.16, 355.26, 360; 242/399, 400.1, 406, 597.6, 597.8, 129; 191/12.2 R, 12.4; 224/162

(56) References Cited

U.S. PATENT DOCUMENTS

| | | | | | |
|---|---|---|---|---|---|
| 2,300,243 | A | | 10/1942 | Zierden | 242/86 |
| 3,604,381 | A | * | 9/1971 | Neidenberg | 242/402 |
| 3,776,262 | A | | 12/1973 | Fritsch | 137/355.16 |
| 4,061,290 | A | * | 12/1977 | Harrill | 242/402 |
| 4,330,005 | A | | 5/1982 | Kjarsgaard | 137/355.28 |
| 5,034,571 | A | * | 7/1991 | Galloway | 191/12.2 A |
| 5,454,500 | A | * | 10/1995 | Chen | 225/46 |
| 5,526,842 | A | * | 6/1996 | Christensen | 137/360 |
| 5,566,898 | A | * | 10/1996 | Cline | 242/379 |
| 5,678,596 | A | * | 10/1997 | Corallo | 137/357 |
| 5,678,599 | A | * | 10/1997 | Moss | 137/377 |
| 5,679,925 | A | * | 10/1997 | Dilley | 174/53 |
| 5,740,581 | A | | 4/1998 | Harrelson, II | 137/355.16 |
| 5,773,757 | A | * | 6/1998 | Kenney et al. | 174/53 |
| 5,806,786 | A | | 9/1998 | Abe et al. | 242/588.6 |
| 5,813,624 | A | * | 9/1998 | Grasso et al. | 242/560 |
| 5,921,391 | A | | 7/1999 | Ortiz et al. | 206/397 |
| 6,050,291 | A | | 4/2000 | Whitehead et al. | 137/355.26 |
| 6,182,327 | B1 | * | 2/2001 | Gosselin | 15/315 |
| 6,241,094 | B1 | | 6/2001 | Anjo et al. | 206/397 |
| 6,546,953 | B1 | * | 4/2003 | Kowalke | 137/355.16 |
| 6,672,329 | B1 | * | 1/2004 | Brooks et al. | 137/355.2 |
| 2003/0192592 | A1 | * | 10/2003 | Warning | 137/355.12 |

* cited by examiner

*Primary Examiner*—Mickey Yu
(74) *Attorney, Agent, or Firm*—Davis & Bujold, P.L.L.C.

(57) ABSTRACT

A storage device for coiled articles, such as electrical cords and hoses, includes a tubular plug adapted to be imbedded in a wall cavity. A spool is provided which is adapted to hold coiled articles. The spool is telescopically received within the tubular plug. The spool is movable between an extended position extending from the tubular plug and a retracted position retracted within the tubular plug. At least one spool guide couples the spool and the tubular plug and provides cantilever support to the spool when the spool is in the extended position. A locking engagement is provided for locking the spool in the retracted position. This storage device provides improves aerodynamics and aesthetics. It is particularly suited for the recreational vehicle market, where there are width restrictions prescribed by law.

22 Claims, 9 Drawing Sheets

STORAGE DEVICE FOR COILED ARTICLES

This application claims priority from Canadian Application Serial No. 2,435,015 filed Jul. 11, 2003.

FIELD OF THE INVENTION

The present invention relates to a storage device for coiled articles, such as electrical cords and hoses.

BACKGROUND OF THE INVENTION

Electrical cords and hoses are commonly stored on spools. Such spools can be mounted to a vertical surface, such as a wall to facilitate use. The use of a wall mounted spool is not suitable for all applications. For example, it is not suitable for applications in which aerodynamic performance is important. An example of such an application is with recreational vehicles. Recreational vehicles have a need for storage devices to hold electrical cords and hoses. However, it is undesirable, for both functional and aesthetic reasons, to have a spool hanging off a side of the recreational vehicle as it travels down a highway. There are also legal restrictions on maximum vehicle width, that must be taken into consideration.

SUMMARY OF THE INVENTION

What is required is a storage device for coiled articles which can meet the needs of applications in which aesthetic appearance, width restrictions or aerodynamic performance are important.

According to the present invention there is provided a storage device for coiled articles which includes a tubular plug adapted to be imbedded in a wall cavity. A spool is provided which is adapted to hold coiled articles. The spool is telescopically received within the tubular plug. The spool is movable between an extended position extending from the tubular plug and a retracted position retracted within the tubular plug. At least one spool guide couples the spool and the tubular plug and provides cantilever support to the spool when the spool is in the extended position. Means are provided for locking the spool in the retracted position.

With the storage device, as described above, the spool is maintained in the retracted position when not in use. In the retracted position, the spool is hidden out of the way within the tubular plug. When one wishes to use the electrical cord or hose which is stored on the spool, the spool is moved to the extended position during the period of use.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
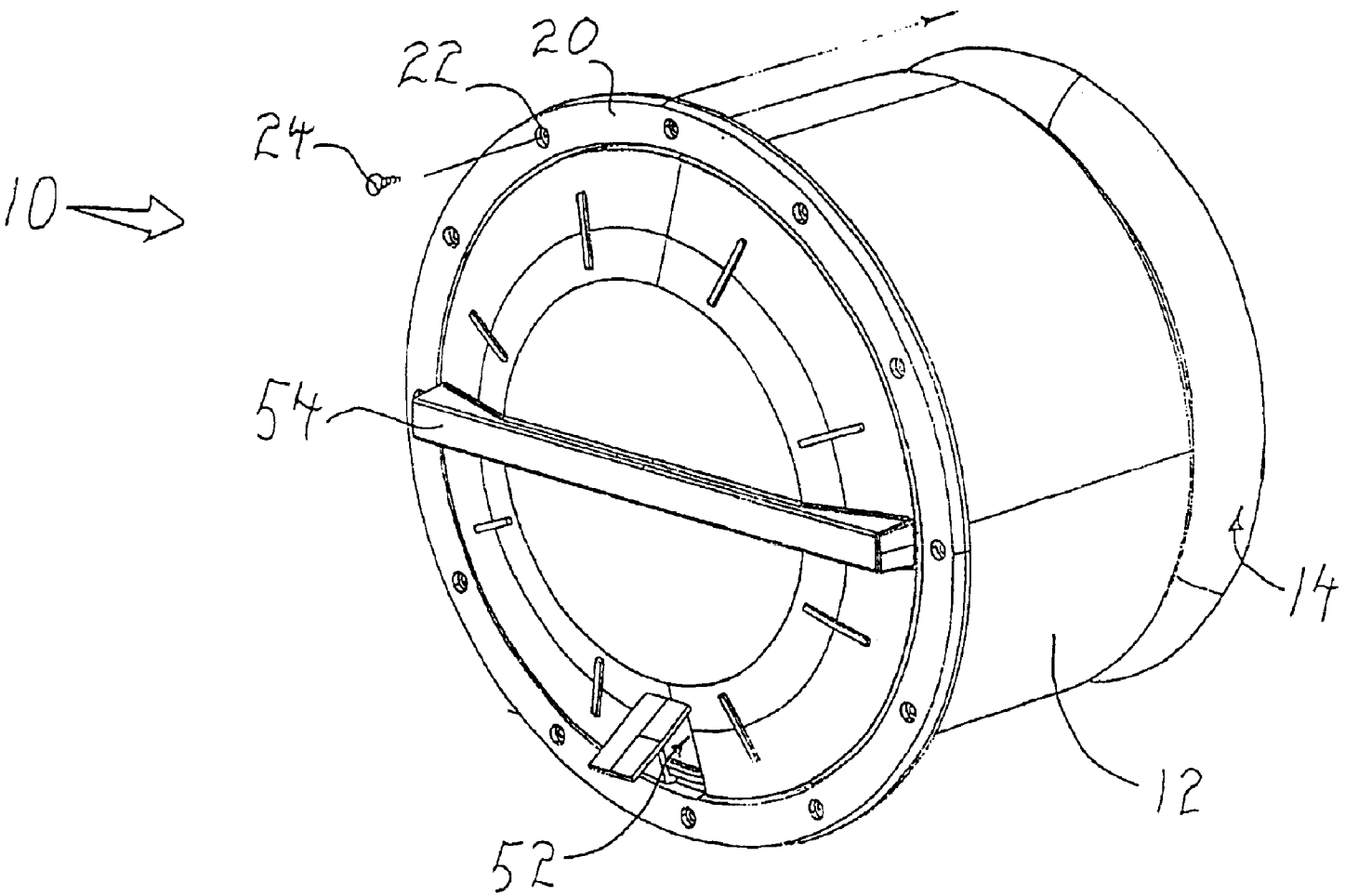
FIG. 1 is a front perspective view of a storage device for coiled articles constructed in accordance with the teachings of the present invention.

The preferred embodiment, a storage device for coiled articles generally identified by reference numeral 10, will now be described with reference to FIGS. 1 through 9.

Structure and Relationship of Parts

Figure 2:
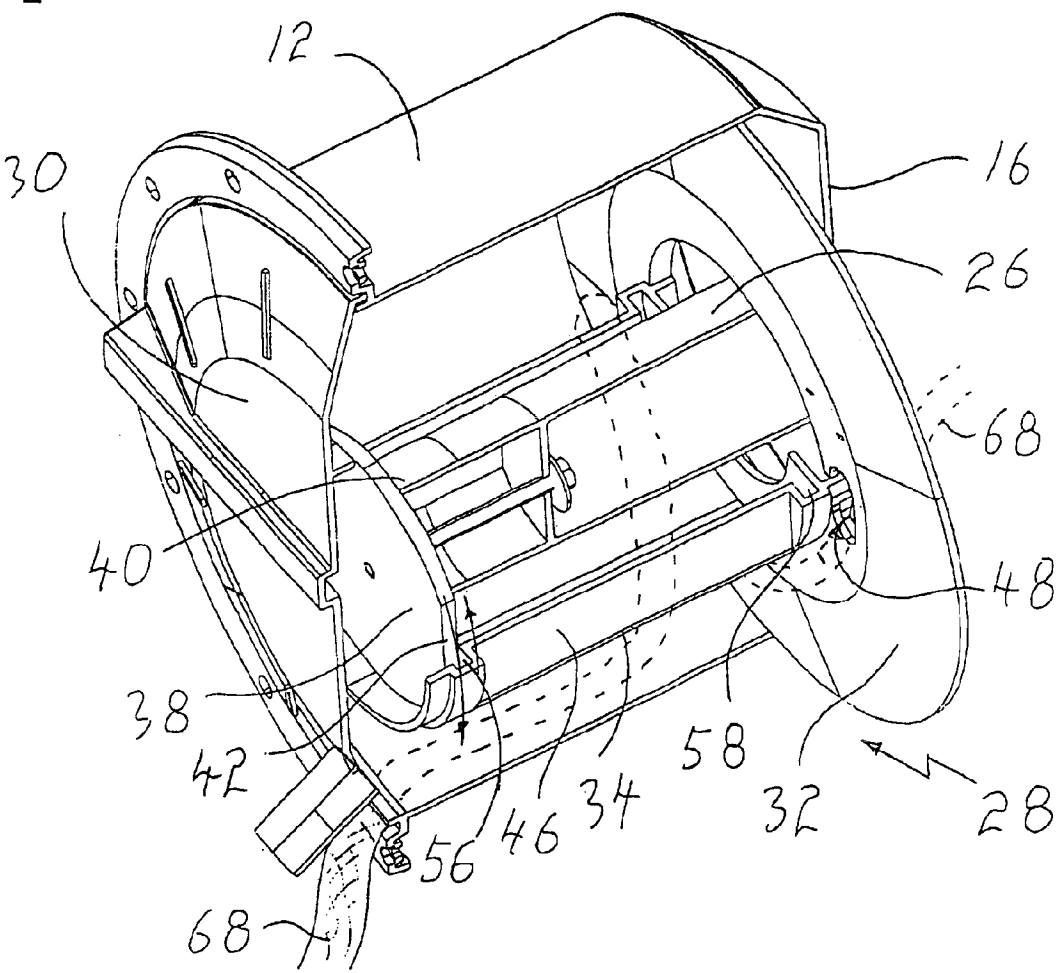
FIG. 2 is a cut away front perspective view of the storage device for coiled articles illustrated in FIG. 1, with the spool in a retracted position.
Figure 3:
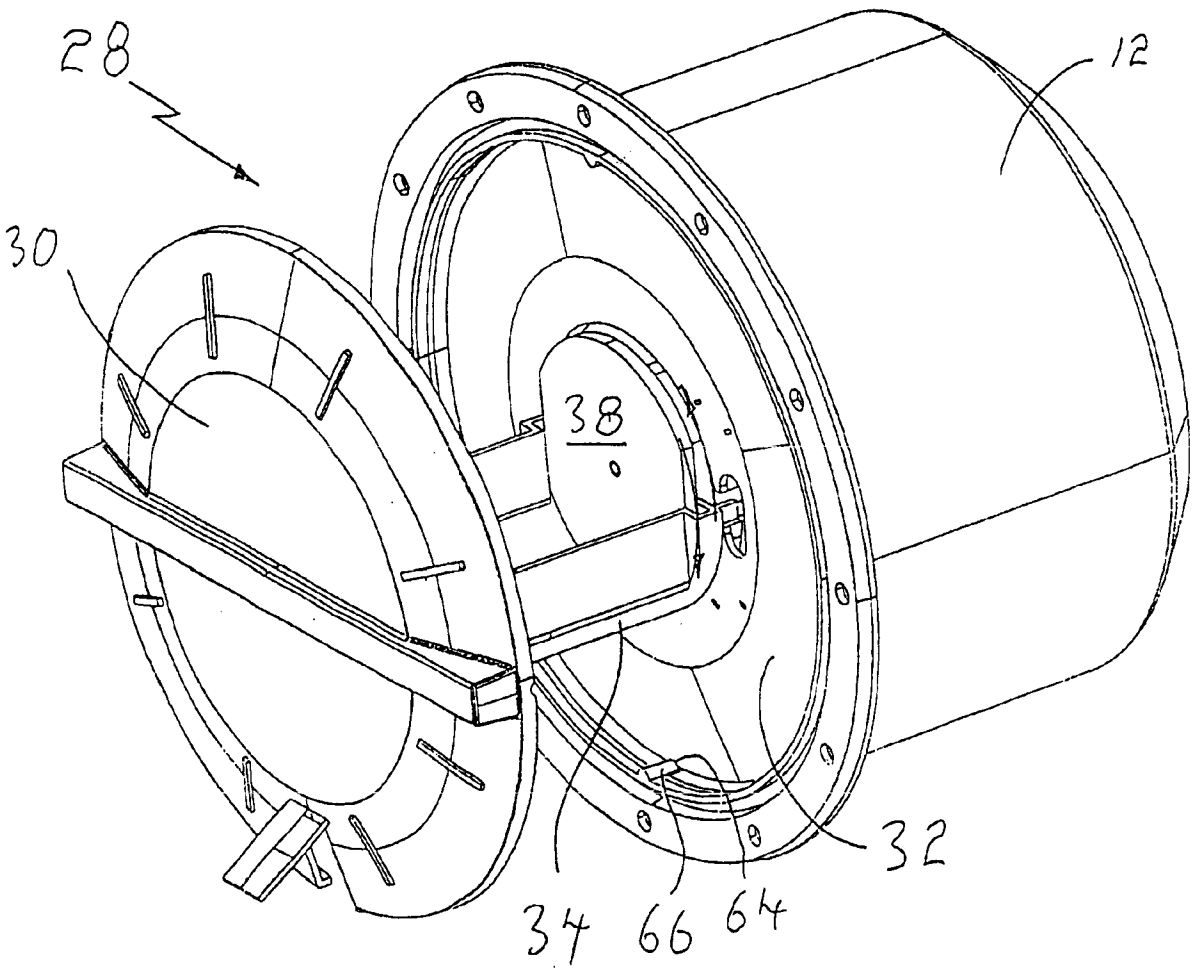
FIG. 3 is a cut away front perspective view of the storage device for coiled articles illustrated in FIG. 1, with the spool in an extended position.
Figure 4:
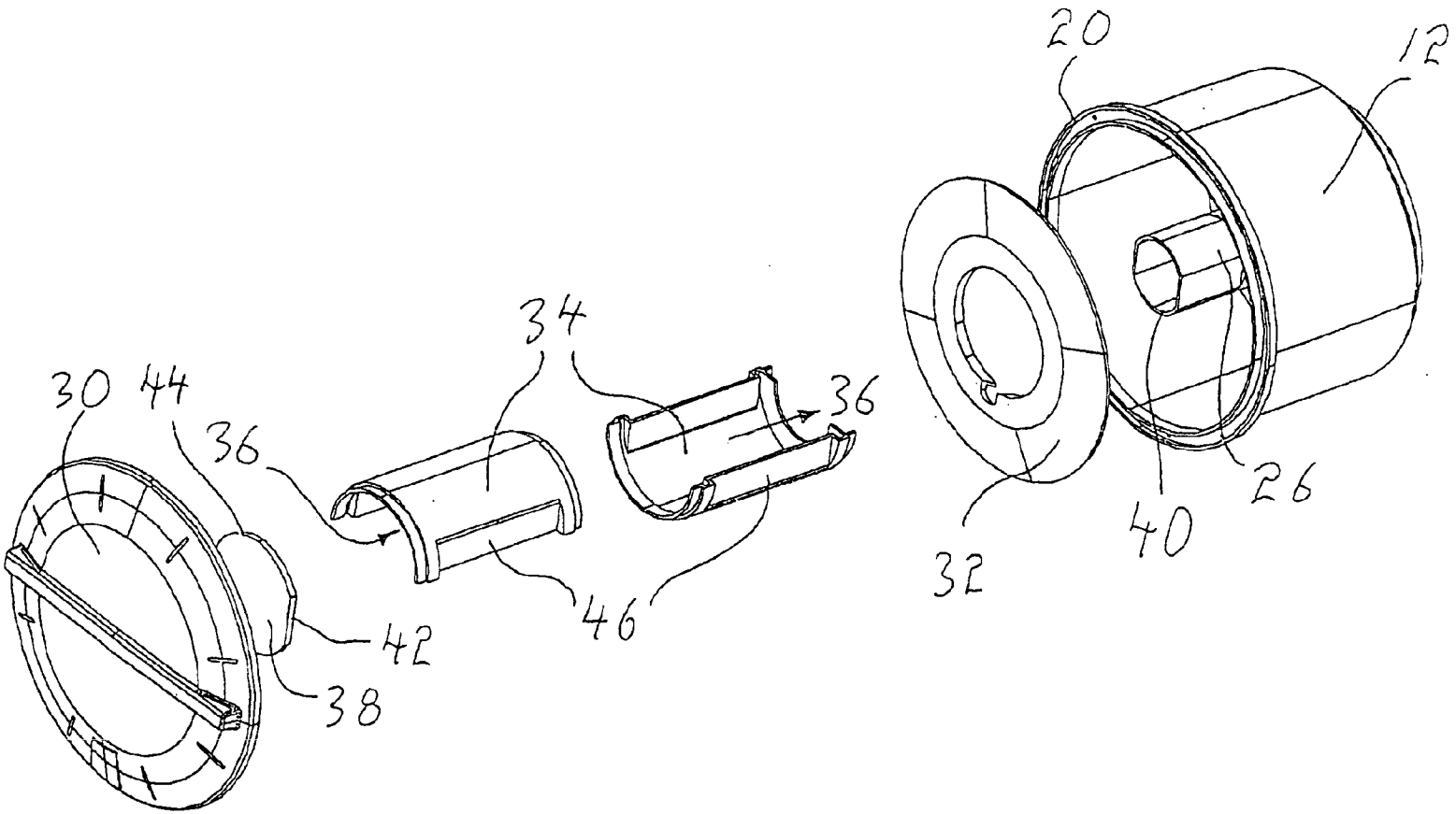
FIG. 4 is an exploded front perspective view of the storage device for coiled articles illustrated in FIG. 1.
Figure 5:
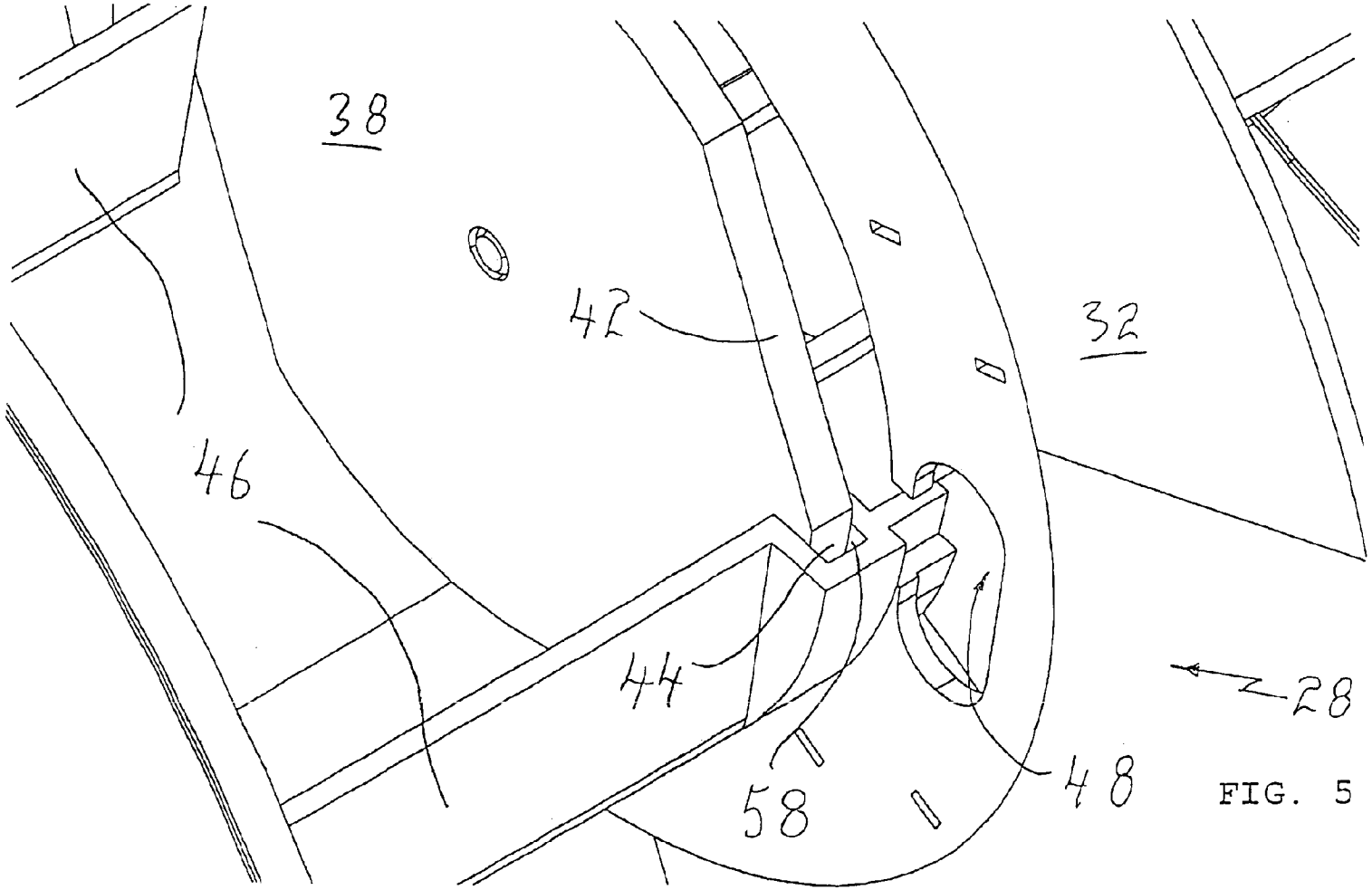
FIG. 5 is a detailed view of the guide post end plate of the storage device for coiled articles illustrated in FIG. 1, engaged with the first hub locking engagement slot.
Figure 6:
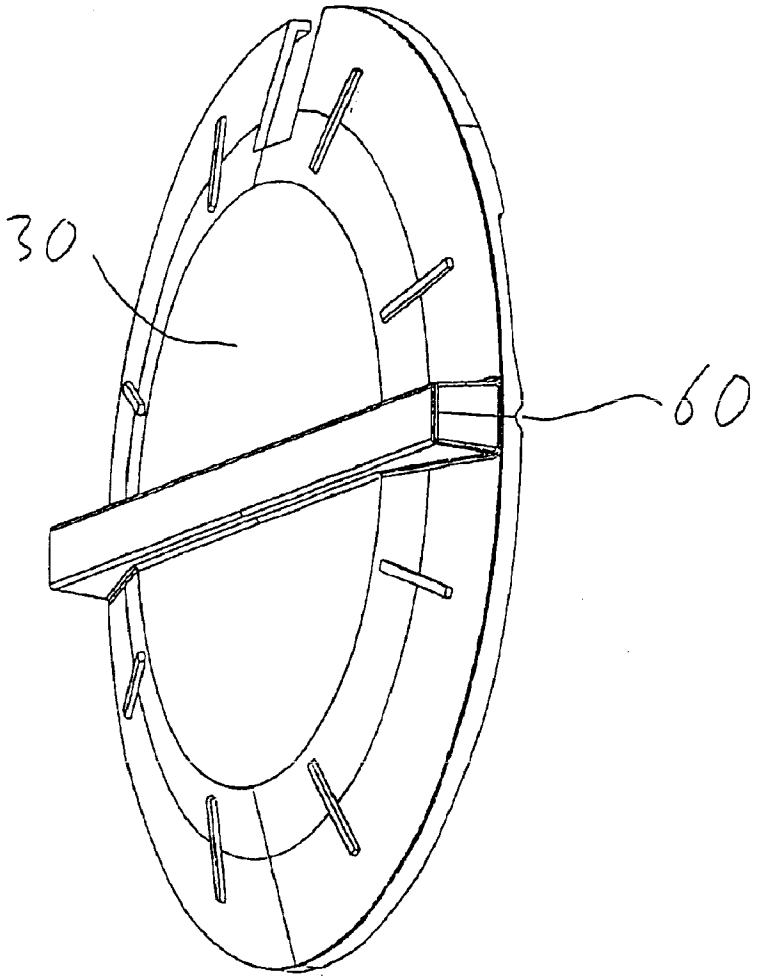
FIG. 6 is a perspective view of the first end plate with locking engagement notch of the storage device for coiled articles illustrated in FIG. 1, that maintains the spool in the rotationally locked and retracted position.
Figure 7:
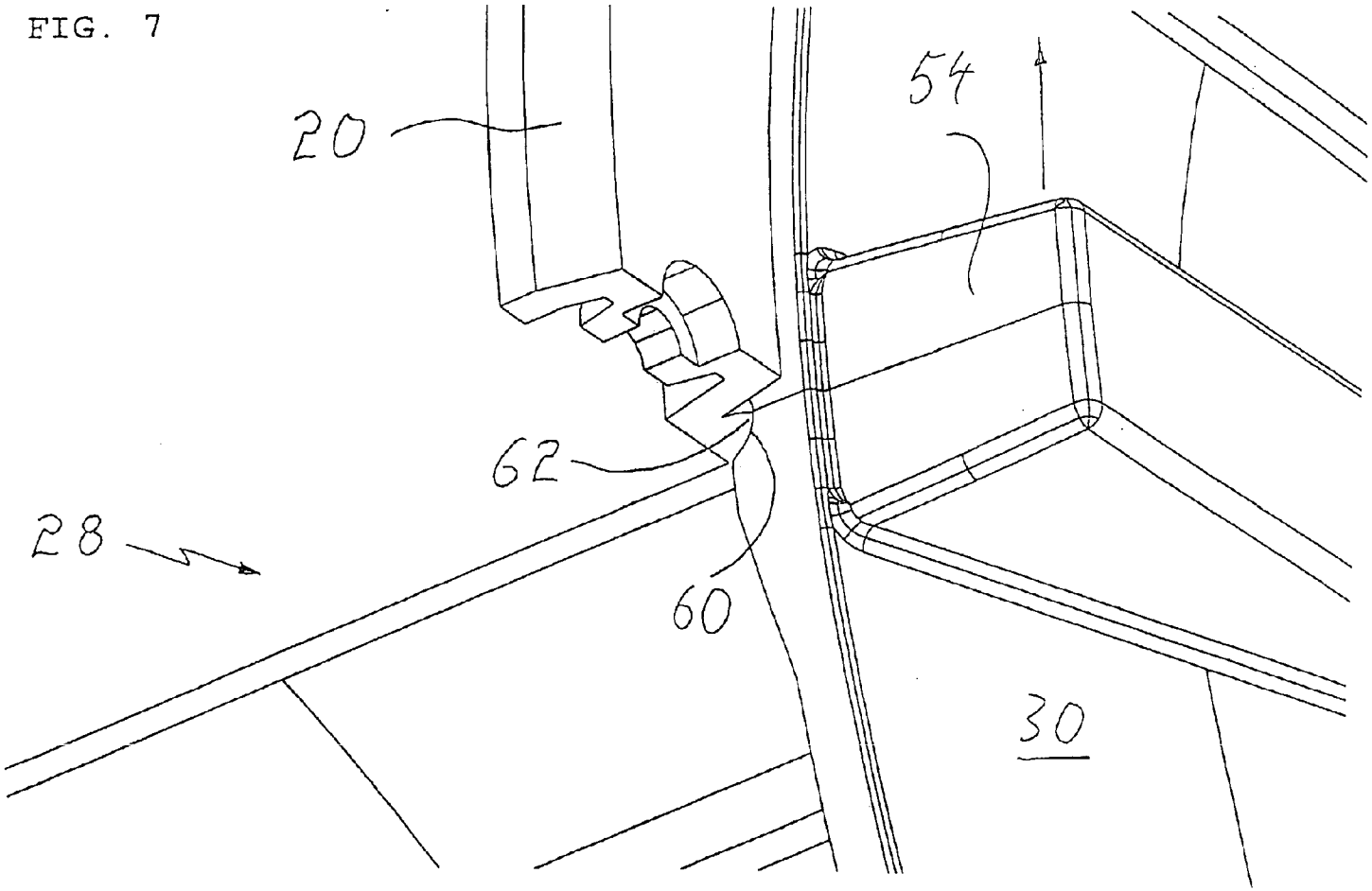
FIG. 7 is a detailed view of the first end plate with locking engagement notch illustrated in FIG. 5 engaged in rotationally locked retracted position with the tubular plug.
Figure 8:
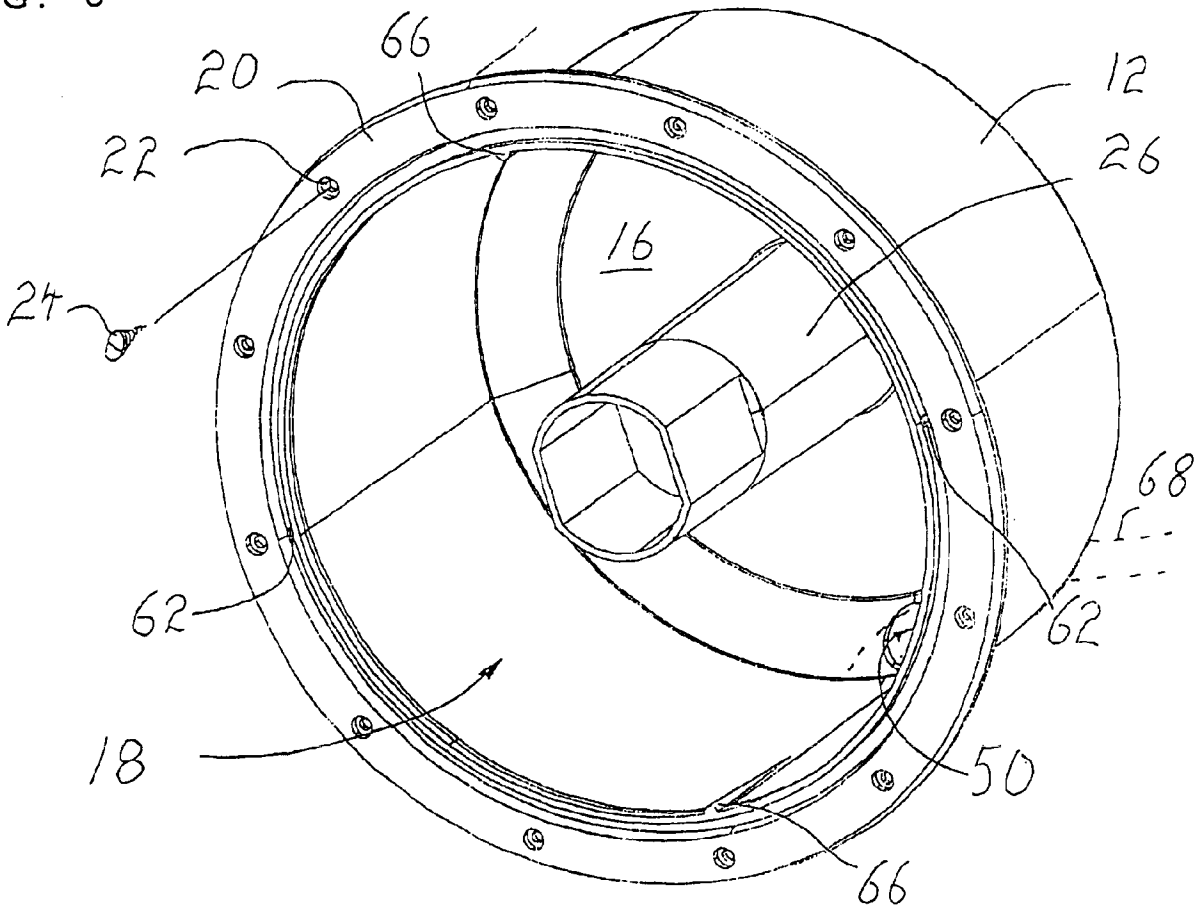
FIG. 8 is a front perspective view of a tubular plug with guide post of the storage device for coiled articles illustrated in FIG. 1 with the spool and end cap removed.
Figure 9:
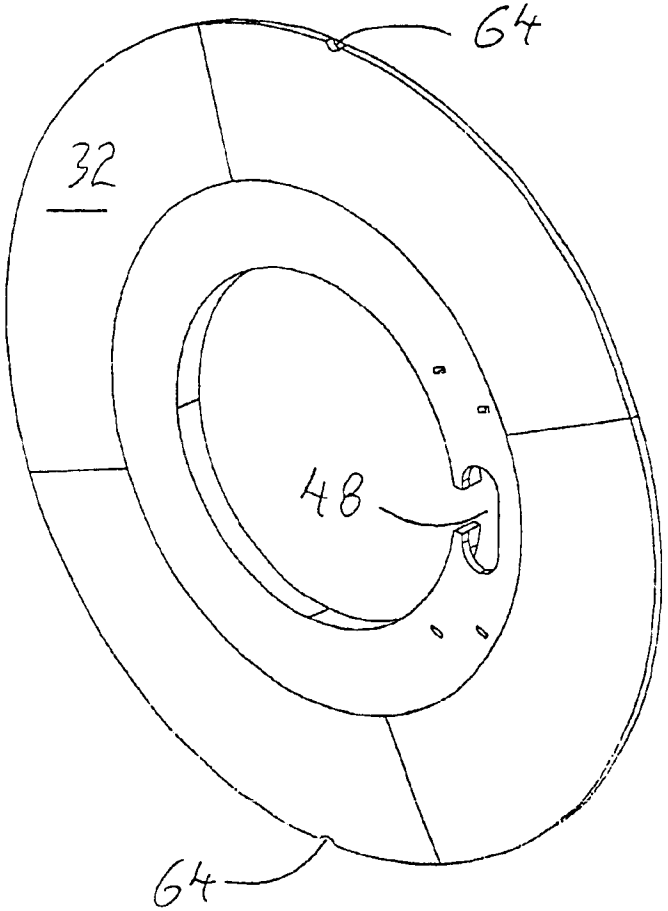
FIG. 9 is a detailed view of the second end plate of the storage device for coiled articles illustrated in FIG. 1.

Referring to FIG. 1, storage device for coiled articles 10 has a tubular plug 12, adapted to be embedded in a wall cavity 14. Referring to FIG. 2, plug 12 has a back wall 16. Referring to FIG. 8, plug 12 has an opening 18 opposed to back wall 16 and a mounting flange 20 with a plurality of apertures 22 adapted to receive mounting fasteners 24. Back wall 16 is further adapted with a concentrically positioned guide post 26 that extends toward opening 18. Referring to FIG. 2, guide post 26 has an end cap 38 which is fixedly attached to a remote end 40 of guide post 26. Referring to FIG. 3, a spool 28, adapted to hold coiled articles, has a first end plate 30, a second end plate 32 and a hollow cylindrical hub 34 that extends between first end plate 30 and second end plate 32. Referring to FIG. 4, hub 34 (shown in two halves) has a central guide channel 36 which overlies guide post 26 and end cap 38, such that hub 34 of spool 28 slides over guide post 26, permitting spool 28 to be telescopically received within tubular plug 12. Referring to FIG. 4, end cap 38 has two bevelled edge 42 and two opposed rounded tangs 44. As will hereinafter further explained rounded tangs 44 serve as a cam engagement surface. Hub 34 is also adapted with an interior profile with flat surfaces 46. Referring to FIG. 3, spool 28 is movable between an extended position extending from tubular plug 12, and, referring to FIG. 2, a retracted position retracted within tubular plug 12. When bevelled edge 42 is aligned with flat surface 46 at a position between the extended position and the retracted position, spool 28 is allowed to 'sleeve over' guide post 26 but not rotate. Referring to FIG. 3, guide post 26 and end cap 38 further provide cantilever support to spool 28 when it is in the extended position. Referring to FIG. 9, second end plate 32 is adapted with a first aperture 48 adapted to allow a coiled article to pass through for the purpose of connecting to a water source (for a hose) or an electrical power source (for an electrical cord). Referring to FIG. 8, back wall 16 has a second aperture 50 also adapted to allow a coiled article to pass. Referring to FIG. 1, first end plate 30 has a third aperture with cover 52 allowing a selected length of coiled article to project for use outside storage device 10. First end plate 30 is also adapted with a handle 54. Referring to FIG. 2, hub 34 is adapted with a first hub locking engagement slot 56 located adjacent to first end plate 30 and a second hub locking engagement slot 58 located adjacent to second end plate 32. Slot 56 and slot 58 are oriented to receive rounded tang 44 of end cap 38. Referring to FIG. 3, when spool 28 is positioned in the extended position, it may then be rotated such that tang 44 locks with second hub locking engagement slot 58. Similarly, referring to FIG. 2, when spool 28 is positioned in the retracted position, it may then be rotated such that tang 44 locks with first hub locking engagement slot 56. Referring to FIG. 5, spool 28 is shown as rotated to lock second hub locking engagement slot 58 with tang 44, to lock spool 28 in the extended position. Referring to FIG. 6, first end plate 30 is adapted with a first end plate locking engagement notch 60. Referring to FIG. 8, tubular plug 12 is adapted with a first tubular plug locking engagement projection 62. Referring to FIG. 7, notch 60 receives projection 62 to rotationally lock spool 28 in the retracted position, so that tang 44 is maintained engaged with second hub locking engagement slot 58. Referring to FIG. 9, second end plate 32 is adapted with a second end plate engagement notch 64. Referring to FIG. 8, tubular plug 12 is adapted with a second tubular plug engagement projection 66. Referring to FIG. 3, notch 64 receives projection 66 to rotationally lock spool 28 in the extended position, so that tang 44 is maintained engaged with first hub locking engagement slot 56.

Operation

The use and operation of a storage device for coiled articles 10 will now be described with reference to FIGS. 1 through 9. Referring to FIG. 1, storage device 10 may be installed into a wall cavity 14 such that its profile becomes substantially flush with the surface of the vehicle or other application. Referring to FIG. 2, in the retracted position, a coiled article 68, such as a hose or electrical cord, may be stored on spool 28 within plug 12. The hose or electrical cord is coiled about hub 34. Referring to FIG. 2, a connection end of the coiled article is routed through first aperture 48 and, referring to FIG. 8, routed through second aperture 50. Referring to FIG. 2, when in the retracted position, spool 28 is rotated and locked, engaging tang 44 into slot 56. Referring to FIG. 7, projection 62 is engaged with notch 60, to maintain tang 44 engaged with slot 56. Where an operator desires to use the coiled article, he applies rotational force to handle 54, disengaging projection 62 from notch 60. Referring to FIG. 2, upon rotation, tang 44 is disengaged from slot 56 such that bevelled edge 42 is aligned with flat surface 46. Referring to FIG. 3, spool 28 may now be extended. Referring to FIG. 5, by applying rotational force, the operator may engage tang 44 with slot 58, locking spool 28 into the extended position. Referring to FIG. 3, projection 66 is further engaged with notch 64, to maintain tang 44 engaged with slot 58. Referring to FIG. 2, where an operator wishes to use the coiled article, yet maintain storage device 10 in a flush orientation, a select length of coiled article may be projected through third aperture with cover 52 and spool 28 may be returned to the retracted position.

Variations

It will be understood that the reference in this application to a "tubular" plug, is intended to encompass different configurations. Just as there can be round tubing and square tubing, there can be a tubular plug that is square. Although this apparatus was originally developed for the recreational vehicle market, it has other applications. There is no reason why this product could not be used at a residence or commercial establishment to conceal hoses, electrical cords or other coiled articles.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A storage device for coiled articles, comprising:

a tubular plug adapted to be imbedded in a wall cavity;

a spool adapted to hold coiled articles, the spool being telescopically received within the tubular plug, the spool being movable between an extended position extending from the tubular plug and a retracted position retracted within the tubular plug;

at least one spool guide coupling the spool and the tubular plug, the at least one spool guide providing cantilever support to the spool when the spool is in the extended position; and means for locking the spool in the retracted position.

2. The storage device as defined in claim 1, wherein the tubular plug has a mounting flange having a plurality of apertures adapted to receive mounting fasteners.

3. The storage device as defined in claim 1, wherein the tubular plug has a back wall and the at least one spool guide includes at least one guide post that extends concentrically inward from the back wall, the spool having at least one guide channel which overlies and slides along the at least one guide post.

4. The storage device as defined in claim 3, wherein the tubular plug has a single central guide post and the spool has a single guide channel provided by a hollow central cylindrical hub.

5. The storage device as defined in claim 4, wherein the central guide post has an exterior profile with flat surfaces and the guide channel of the central cylindrical hub has an interior profile with flat surfaces, the first profile and the second profile engaging to limit rotation of the spool relative to the tubular plug.

6. The storage device as defined in claim 1, wherein the means for locking the spool in the retracted position includes a first engagement on the spool and a second engagement on the tubular plug, the first engagement and the second engagement becoming engaged upon rotation of the spool relative to the tubular plug when in the retracted position.

7. The storage device as defined in claim 6, wherein the first engagement is a slot on the spool, and the second engagement is a cam surface on an end plate of the spool guide which engages the slot upon rotation of the spool when in the retracted position.

8. The storage device as defined in claim 1, wherein means are provided for locking the spool in the extended position, including a first engagement on the spool and a second engagement on the tubular plug, the first engagement and the second engagement becoming engaged upon rotation of the spool relative to the tubular plug when in the extended position.

9. The storage device as defined in claim 8, wherein the first engagement is a slot on the spool, and the second engagement is a cam surface on an end plate of the spool guide which engages the slot upon rotation of the spool when in the extended position.

10. The storage device as defined in claim 7, wherein means are provided to rotationally lock the spool when in the retracted position to prevent the cam surface on the end plate from becoming disengaged from the slot in the spool, when in the retracted position.

11. The storage device as defined in claim 9, wherein means are provided to rotationally lock the spool when in the extended position to prevent the cam surface on the end plate from becoming disengaged from the slot in the spool, when in the extended position.

12. The storage device as defined in claim 10, wherein the means to rotationally lock the spool when in the retracted position includes a first engagement notch in a first end plate on the spool which engages a first engagement projection in the plug.

13. The storage device as defined in claim 11, wherein the means to rotationally lock the spool when in the extended position includes a second engagement notch in a second end plate of the spool which engages a second engagement projection in the plug.

14. The storage device as defined in claim 1, wherein the spool has a first end plate and a second end plate, a passage for coiled articles being provided through the first end plate.

15. A storage device for coiled articles, comprising:

a tubular plug adapted to be imbedded in a wall cavity, the tubular plug having a back wall, and an opening opposed to the back wall, the opening having a mounting flange with a plurality of apertures adapted to receive mounting fasteners, the back wall having a concentrically positioned guide post that extends toward the mouth;

a spool adapted to hold coiled articles, the spool having a first end plate, a second end plate and a hollow cylindrical hub that extends between the first plate and the second plate, the hub having a central guide channel which overlies the guide post, such that the hub of the spool slides along the guide post permitting the spool to be telescopically received within the tubular plug, the spool being movable between an extended position extending from the tubular plug and a retracted position retracted within the tubular plug, the guide post providing cantilever support to the spool when the spool is in the extended position;

the guide post having an exterior profile with flat surfaces and the guide channel of the hub having an interior profile with flat surfaces, the first profile and the second profile engaging to limit rotation of the spool relative to the tubular plug; and a first locking engagement being provided on the spool and a second locking engagement being provided on the tubular plug, the first locking engagement and the second locking engagement becoming engaged upon rotation of the spool relative to the tubular plug when in the retracted position to lock the spool in the retracted position.

16. The storage device as defined in claim 15, wherein the first end plate of the spool has a lip which covers the mounting flange of the tubular plug, and a handle by means of which the spool may be moved from the retracted position to the extended position.

17. The storage device as defined in claim 15, wherein the second end plate of the spool has a first aperture which is adapted to permit passage of a connective end of a coiled article, and the back wall of the tubular plug has a second aperture which is adapted to permit passage of the connective end of the coiled article.

18. The storage device as defined in claim 15, wherein the first engagement is in the form of a slot on the spool, and a second engagement is in the form of a cam surface on an end plate of the guide post which engages the slot upon rotation of the spool when in the retracted position.

19. The storage device as defined in claim 18, wherein a first engagement notch in the first end plate of the spool engages a first engagement projection in the plug to rotationally lock the spool when in the extended position to prevent the cam surface on the end plate from becoming disengaged from the slot when the spool is in the retracted position.

20. The storage device as defined in claim 15, wherein means are provided for locking the spool in the extended position, including a first engagement on the spool and a second engagement on the tubular plug, the first engagement and the second engagement becoming engaged upon rotation of the spool relative to the tubular plug when in the extended position.

21. The storage device as defined in claim 20, wherein a second engagement notch in the second end plate of the spool which engages a second engagement projection in the plug to rotationally lock the spool when in the extended position to prevent the cam surface on the end plate from becoming disengaged from the slot when the spool is in the extended position.

22. The storage device as defined in claim 15, wherein a passage for coiled articles is provided through the first end plate.

* * * * *